US008186791B2

(12) United States Patent
Yamashita

(10) Patent No.: US 8,186,791 B2
(45) Date of Patent: May 29, 2012

(54) LIQUID EJECTING APPARATUS AND CONTROL METHOD THEREOF

(75) Inventor: Noriaki Yamashita, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 273 days.

(21) Appl. No.: 12/715,542

(22) Filed: Mar. 2, 2010

(65) Prior Publication Data

US 2010/0225690 A1 Sep. 9, 2010

(30) Foreign Application Priority Data

Mar. 3, 2009 (JP) ..... 2009-048840

(51) Int. Cl.
*B41J 29/38* (2006.01)

(52) U.S. Cl. ..... 347/10

(58) Field of Classification Search ..... None
See application file for complete search history.

(56) References Cited

U.S. PATENT DOCUMENTS

| | | | |
|---|---|---|---|
| 6,783,210 | B2 | 8/2004 | Takahashi et al. |
| 2007/0140917 | A1 | 6/2007 | Yamashita |
| 2007/0273719 | A1 | 11/2007 | Yamashita |

FOREIGN PATENT DOCUMENTS

| | | |
|---|---|---|
| JP | 2003-011369 | 1/2003 |
| JP | 2007-168216 | 7/2007 |
| JP | 2007-313757 | 12/2007 |
| JP | 2009-035011 | 2/2009 |

*Primary Examiner* — Stephen Meier
*Assistant Examiner* — Alexander C Witkowski
(74) *Attorney, Agent, or Firm* — Workman Nydegger

(57) ABSTRACT

A liquid ejecting apparatus includes a liquid ejecting head with a group of nozzles. The liquid ejecting apparatus drives a pressure generating element to generate pressure variation in a liquid in a pressure generating chamber and ejects the liquid from the nozzles using the pressure variation. A driving signal generating unit generates a driving signal including an ejection driving pulse which drives the pressure generating element. An ejection control unit controls application of the ejection driving pulse to the pressure generating element to control a liquid ejecting operation of the liquid ejecting head. The driving signal generating unit generates first and second ejection driving pulses. The ejection control unit calculates a timing at which the amount of the ejected liquid becomes a predetermined correction target value in transition of the ejected liquid amount of each nozzle from a start of the ejecting operation.

5 Claims, 6 Drawing Sheets

LIQUID EJECTING APPARATUS AND CONTROL METHOD THEREOF

BACKGROUND

1. Technical Field

The present invention relates to a liquid ejecting apparatus such as an ink jet printer and a control method thereof, and more particularly, to a liquid ejecting apparatus in which a liquid is introduced from a liquid reservoiring member to a pressure generating chamber and is provided to a pressure generating element thereby to eject the liquid in the pressure generating chamber from a nozzle and a control method thereof.

2. Related Art

A liquid ejecting apparatus is an apparatus which includes a liquid ejecting head capable of ejecting a liquid and ejects a variety of liquids from the liquid ejecting head. The representative example of the liquid ejecting apparatus is an image recording apparatus, such as an ink jet printer (hereinafter, simply referred to as a printer) which includes an ink jet recording head (hereinafter, simply referred to as a recording head) and records an image or the like by ejecting and landing liquid ink onto a recording medium (landing target) such as a recording paper from nozzles of the recording head. In recent years, the liquid ejecting apparatus has been applied to a variety of manufacturing apparatuses such as an apparatus manufacturing a color filter for use in a liquid crystal display or the like, as well as the image recording apparatus.

The printer is configured so that pressure of the liquid in the pressure generating chamber is varied and ink is ejected from nozzles using the pressure variation. In such a printer, a pressure generating unit such as a piezoelectric vibrator is provided to correspond to each pressure generating chamber, and an ejection driving pulse is applied to the pressure generating unit so as to drive the pressure generating unit, thereby varying the pressure of the liquid in the pressure generating chamber. By controlling the pressure variation, the ink may be ejected. The ejection driving pulse is set to have various shapes in accordance with the type of the pressure generating unit for use or the amount of the ink to be ejected, etc. In this respect, it is important to minutely determine a driving voltage (which is a potential difference between the lowest potential and the highest potential) for any ejection driving pulse. This is because the amount of the ejected ink varies according to the size of the driving voltage. In addition, since the optimal value of the driving voltage is different for every recording head, the optimal value of the driving voltage is determined for every recording head (see JP-A-2003-011369).

However, for example, in the case that a so-called solid recording in which a predetermined region in the recording medium such as a recording paper is filled closely with dots without any gap is executed, the ink is continuously ejected from each nozzle with a short cycle by simultaneously driving a plurality of piezoelectric vibrators. In this case, a flow speed in an ink supply passage which extends from an ink cartridge to the recording head increases and flow resistance becomes high, thereby causing pressure loss. In other words, in the case that a large amount of ink is consumed as in the solid recording, a desired ejection characteristic is obtained immediately after starting an ejecting operation of the ink, whereas the weight or speed of the ink ejected from each nozzle is decreased as the flow speed of the ink in the ink supply passage increases. As a result, a problem such as variation in the density of an image to be recorded may occur.

In order to prevent such a problem, it is possible to adopt a method of dividing the image or the like which has been recorded with one main scanning (pass) of the recording head in the related art into a plurality of passes for recording. In this case, however, the recording speed decreases as the pass increases.

SUMMARY

An advantage of some aspects of the invention is that it provides a liquid ejecting apparatus capable of reducing deterioration of an ejection characteristic even in the case that pressure loss occurs due to the increase in a flow speed of a liquid in a liquid supply passage and a method of controlling the liquid ejecting apparatus.

According to an aspect of the invention, there is provided a liquid ejecting apparatus including: a liquid ejecting head which includes a nozzle group formed by arranging a plurality of nozzles, introduces a liquid to a pressure generating chamber through a liquid supply passage from a liquid supply source, drives a pressure generating element to generate pressure variation in the liquid in the pressure generating chamber and ejects the liquid from the nozzles using the pressure variation; a driving signal generating unit which generates a driving signal including an ejection driving pulse which drives the pressure generating element; and an ejection control unit which controls an application of the ejection driving pulse to the pressure generating element to control a liquid ejecting operation of the liquid ejecting head. The driving signal generating unit is capable of generating a first ejection driving pulse and a second ejection driving pulse which generates pressure variation larger than that of the first ejection driving pulse. The ejection control unit calculates a timing T at which the amount of the ejected liquid becomes a predetermined correction target value Iwx in transition of the ejected liquid amount of each nozzle from the start of the ejecting operation, on the basis of the following formula (NF), $T=-\mathrm{Log}((Iwx-D)/A)\times\tau$, and switches the ejection driving pulse which drives the pressure generating element from the first ejection driving pulse to the second ejection driving pulse at the calculated timing T, where in the formula (NF), A refers to a variation in the ejected liquid amount from the start of the ejecting operation to a normal state via a transitional state (in the case that correction is not performed), D refers to an asymptotic value of the ejected liquid amount in the normal state (in the case that correction is not performed), and $\tau$ refers to a time constant ($\tau=M/R$) based on inertance M and flow passage resistance R in the liquid supply passage.

With such a configuration, since the ejection driving pulse for driving the pressure generating element is switched from the first ejection driving pulse to the second ejection driving pulse at the timing T when the corresponding ejected liquid amount becomes the predetermined correction target value Iwx in the transition of the ejected liquid amount of each nozzle from the start of the ejecting operation, it is possible to prevent deterioration of the ejection characteristic at a suitable timing even in the case that pressure loss is generated by an increase in the flow speed of the liquid in the liquid supply passage. As a result, it is impossible to reduce the irregularity in the density of the liquid on the landing target.

With such a configuration, it is preferable that the ejection control unit calculates the variation A on the basis of ejecting data for each unit of relative movement between the liquid ejecting head and the landing target.

In addition, with such a configuration, the ejection control unit may perform the switching of the ejection driving pulse according to the transition in the ejected liquid amount at the time of the liquid ejecting operation corresponding to a region in which the liquid is landed with a relatively high density compared with another region of the landing target.

Moreover, with such a configuration, the ejection control unit may estimate the variation A from a continuous ejecting time.

According to another aspect of the invention, there is provided a method of controlling a liquid ejecting apparatus including: a liquid ejecting head which includes a nozzle group formed by arranging a plurality of nozzles, introduces a liquid to a pressure generating chamber through a liquid supply passage from a liquid supply source, drives a pressure generating element to generate pressure variation in the liquid in the pressure generating chamber and ejects the liquid from the nozzles using the pressure variation; a driving signal generating unit which generates a driving signal including an ejection driving pulse which drives the pressure generating element; and an ejection control unit which controls an application of the ejection driving pulse to the pressure generating element to control a liquid ejecting operation of the liquid ejecting head, the method including: calculating a timing T at which an ejected liquid amount becomes a predetermined correction target value Iwx in transition of the ejected liquid amount of each nozzle from the start of the liquid ejecting operation on the basis of the following formula (NF), $T=-\mathrm{Log}((Iwx-D)/A)\times\tau$; and switching the ejection driving pulse which drives the pressure generating element from a first ejection driving pulse to a second ejection driving pulse which generates pressure variation larger than that of the first ejection driving pulse, where in the formula (NF), A refers to a variation in the ejected liquid amount from the start of the ejecting operation to a normal state via a transitional state (in the case that correction is not performed), D refers to an asymptotic value of the ejected liquid amount in the normal state (in the case that correction is not performed), and $\tau$ refers to a time constant ($\tau=M/R$) based on inertance M and flow passage resistance R in the liquid supply passage.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, a preferred embodiment of the invention will be described with reference to the accompanying drawings. The embodiment described below specifies the invention in various forms as examples of the invention, but the scope of the invention is not limited to these various forms, as long as details limiting the invention are not particularly described in the following description. In addition, an ink jet recording apparatus (hereinafter, referred to as a printer) according to the invention will be described below as an example of a liquid ejecting apparatus.

Figure 1:
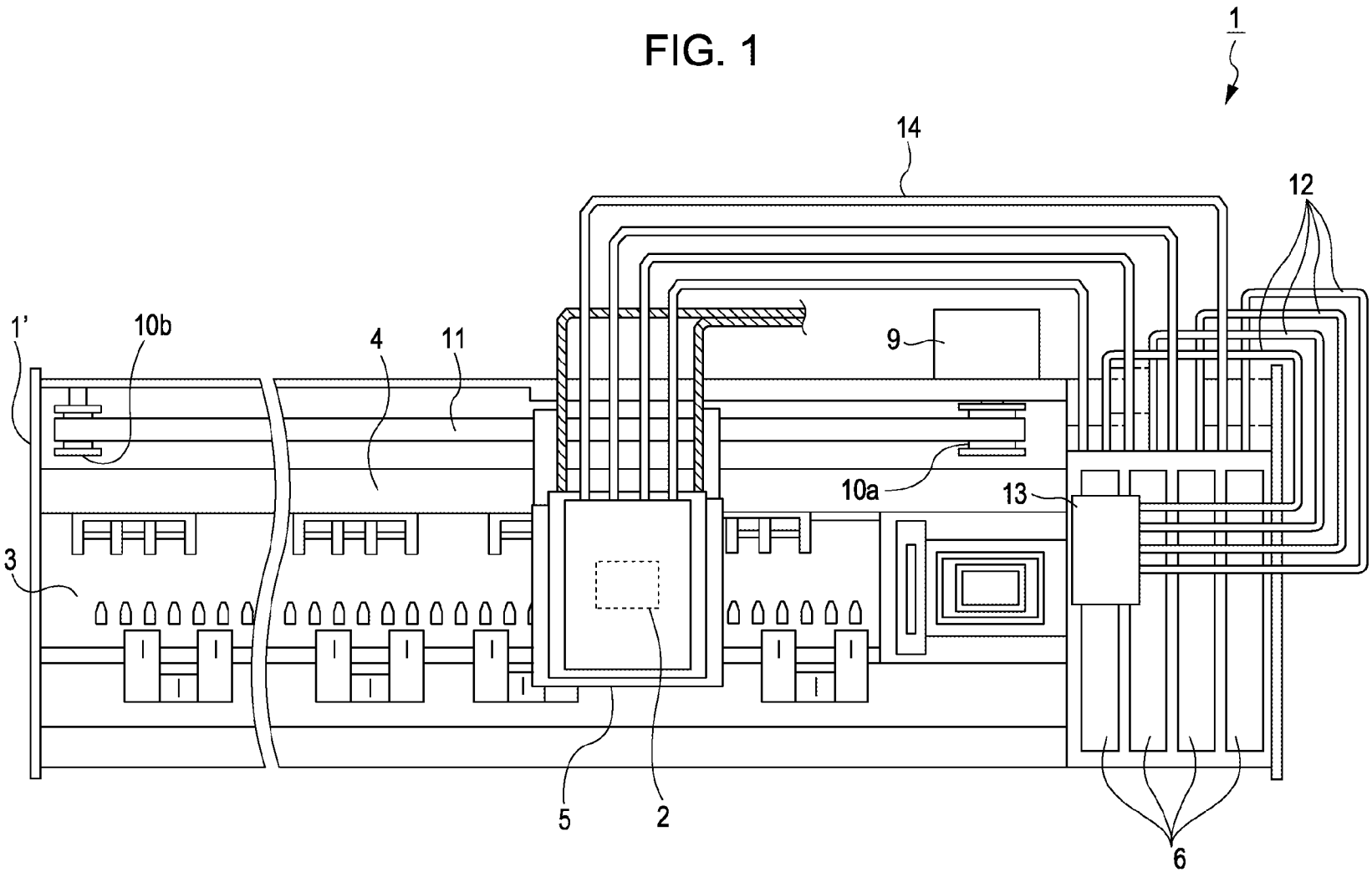
FIG. 1 is a plan view illustrating a configuration of an ink jet printer.

FIG. 1 is a plan view illustrating a configuration of a printer 1 according to the present invention. The printer 1 includes a frame 1' forming a part of an outer appearance and a platen 3 installed in the frame 1'. A recording paper (which is a kind of recording medium or landing target: not shown) is fed onto the platen 3 by a paper feeding roller (not shown) rotated by driving the paper feeding motor in a paper feeding mechanism 8 (see FIG. 3). Further, a guide rod 4 is arranged in parallel with the platen 3 in the frame 1', and a carriage 5 which contains an ink jet recording head 2 (which is a kind of liquid ejecting head, which is hereinafter referred to as a recording head) is slidably supported on the guide rod 4. The carriage 5 is connected to a timing belt 11 stretched between a driving pulley 10*a* which rotates by driving a carriage moving motor 9 and an idle pulley 10*b* disposed opposite to the driving pulley 10*a* in the frame 1'. The carriage 5 reciprocates in a main scanning direction, perpendicular to a paper feeding direction, along the guide rod 4 by driving the carriage moving motor 9. A carriage moving mechanism 7 (see FIG. 3) which serves as a head moving unit includes these components, that is, the carriage moving motor 9, the driving pulley 10*a*, the idle pulley 10*b* and the timing belt 11.

The carriage moving motor 9 serves as a driving source in the carriage moving mechanism 7, and is, for example, configured with a pulse motor or a DC motor. A rotational speed or a rotational direction of the carriage moving motor 9 is controlled by a controller 43 (see FIG. 3) which serves as a control unit. If the carriage moving motor 9 rotates, the driving pulley 10*a* and the timing belt 11 rotate and the carriage 5 moves along the guide rod 4. Accordingly, the recording head 2 mounted on the carriage 5 reciprocates in the main scanning direction under the control of the controller 43. A scanning position of the carriage 5 may be detected by a linear encoder (not shown) which outputs an encoder pulse corresponding to the scanning position as position information in the main scanning direction.

An ink cartridge 6 (which is a kind of liquid supply source) is detachably installed in a side of the frame 1', and four ink cartridges 6 are provided in the present embodiment. The ink cartridge 6 is connected to an air pump 13 via an air tube 12. Air from the air pump 13 is supplied to each ink cartridge 6. Thus, ink is supplied (under pressure) to the recording head 2 through an ink supply tube 14 by pressure in the ink cartridge 6 due to the air. The ink supply tube 14 is made of a flexible hollow member formed by synthetic resin such as silicon. An ink flow passage (which is a kind of liquid supply passage) which corresponds to each ink cartridge 6 is formed in the ink supply tube 14.

Figure 2:
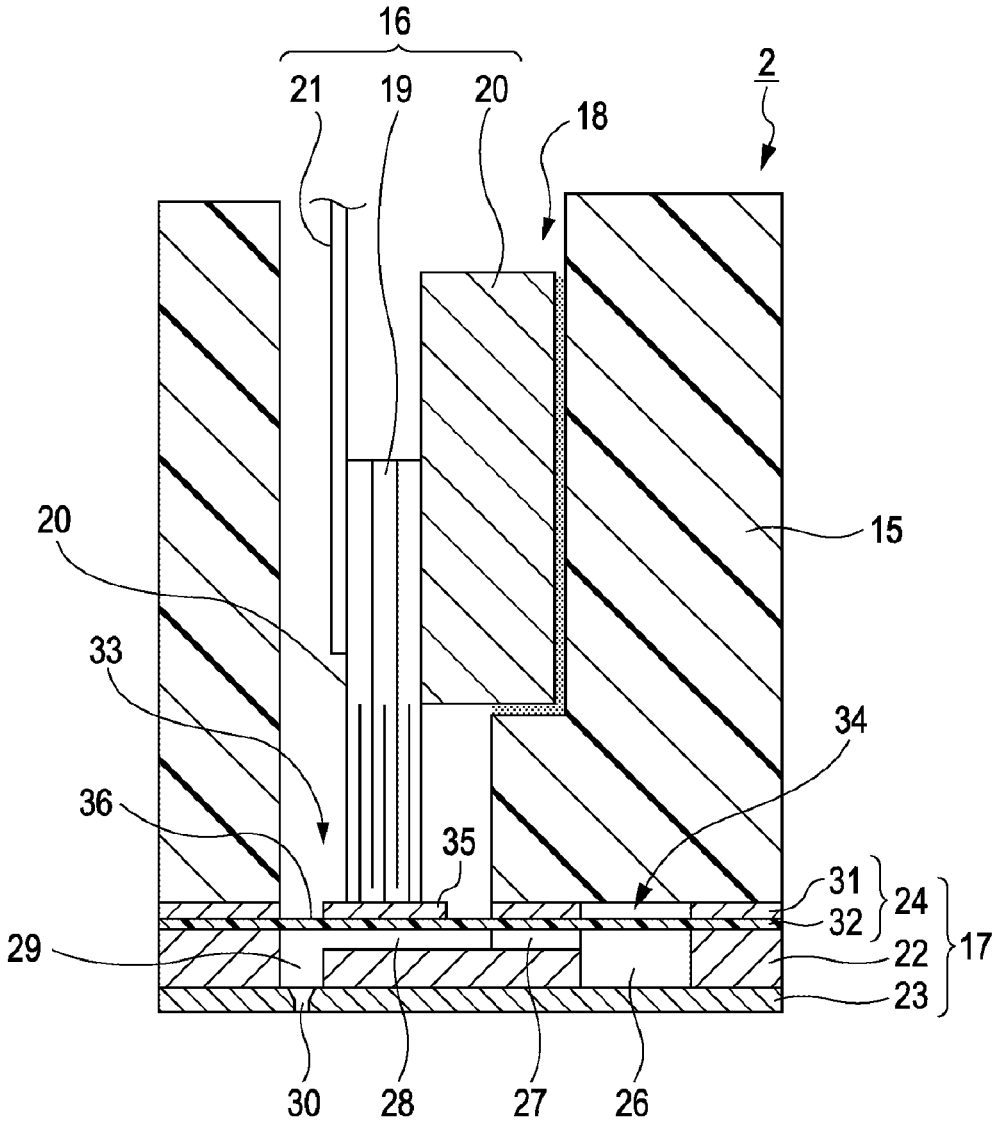
FIG. 2 is a main sectional view of a recording head.

Hereinafter, the recording head 2 will be described with reference to FIG. 2. The recording head 2 illustrated in FIG. 2 is a kind of liquid ejecting head according to the present invention and can eject liquid ink (which is a kind of liquid according to the invention) from a nozzle 30 in a moving state in the main scanning direction by means of the carriage moving mechanism 7.

The recording head 2 includes a case 15, a vibrator unit 16 accommodated in the case 15, and a flow passage unit 17 joined on a bottom surface (front end surface) of the case 15. The case 15 is, for example, formed of epoxy resin and is formed with an accommodating space 18 for accommodating the vibrator unit 16. The vibrator unit 16 includes a piezoelectric vibrator 19 which serves as a pressure generating element, a holding plate 20 to which the piezoelectric vibrator 19 is coupled, and a flexible cable 21 for providing a driving signal or the like to the piezoelectric vibrator 19. The piezoelectric vibrator 19 is a multilayer type which is obtained by cutting a piezoelectric plate, in which a piezoelectric layer and an electrode layer are alternately stacked, with a pectinate shape. The piezoelectric vibrator 19 has a longitudinal vibration mode capable of expanding and contracting in a direction perpendicular to a stacking direction.

The flow passage unit 17 is formed by joining a nozzle plate 23 on one surface of a flow passage forming substrate 22 and a vibration plate 24 on the other surface thereof, respectively. In the flow passage unit 17 are provided a reservoir 26, an ink supply port 27, a pressure generating chamber 28, a nozzle communication port 29 and the nozzle 30. Thus, a series of ink passages which are extended from the ink supply port 27 to the nozzle 30 via the pressure generating chamber 28 and the nozzle communication port 29 is formed to correspond to each nozzle 30. The nozzle plate 23 is a thin metal plate which is perforated by a plurality of nozzles 30 in a row with a pitch corresponding to a dot forming density. According to the present embodiment, the nozzle plate 23 is formed by a stainless plate, and the plurality of rows of the nozzles 30 (nozzle rows (which are a kind of nozzle group)) is arranged. One nozzle row is formed by, for example, 180 nozzles 30.

The vibration plate 24 adopts a dual-layer structure in which an elastic membrane 32 is stacked on a surface of a supporting plate 31. In the present embodiment, a stainless plate which is a kind of metal plate is used as the supporting plate 31, and a resin film is laminated on the surface of the supporting plate 31 as the elastic membrane 32, thereby forming a complex plate member. The vibration plate 24 is formed by the complex plate member. A diaphragm 33 which varies the volume of the pressure generating chamber 28 is installed in the vibration plate 24. Further, a compliance section 34 which seals a part of the reservoir 26 is provided in the vibration plate 24. The diaphragm 33 is formed by partially removing the supporting plate 31 using an etching process or the like. In other words, the diaphragm 33 is provided with an island portion 35 to which a front end surface of the piezoelectric vibrator 19 is coupled, and a thin elastic portion 36 surrounding the island portion 35. The compliance section 34 is formed by removing a region of the supporting plate 31 opposite to an opening surface of the reservoir 26 using the etching process similar to the diaphragm 33, and serves as a damper which absorbs pressure variation in the liquid accommodated in the reservoir 26.

Further, since the front end surface of the piezoelectric vibrator 19 is coupled to the island portion 35, the volume of the pressure generating chamber 28 may be varied by expanding and contracting a free end portion. The pressure variation in the ink in the pressure generating chamber 28 is generated according to the volume variation. Thus, the recording head 2 ejects ink droplets from the nozzle 30 using the pressure variation.

Figure 3:
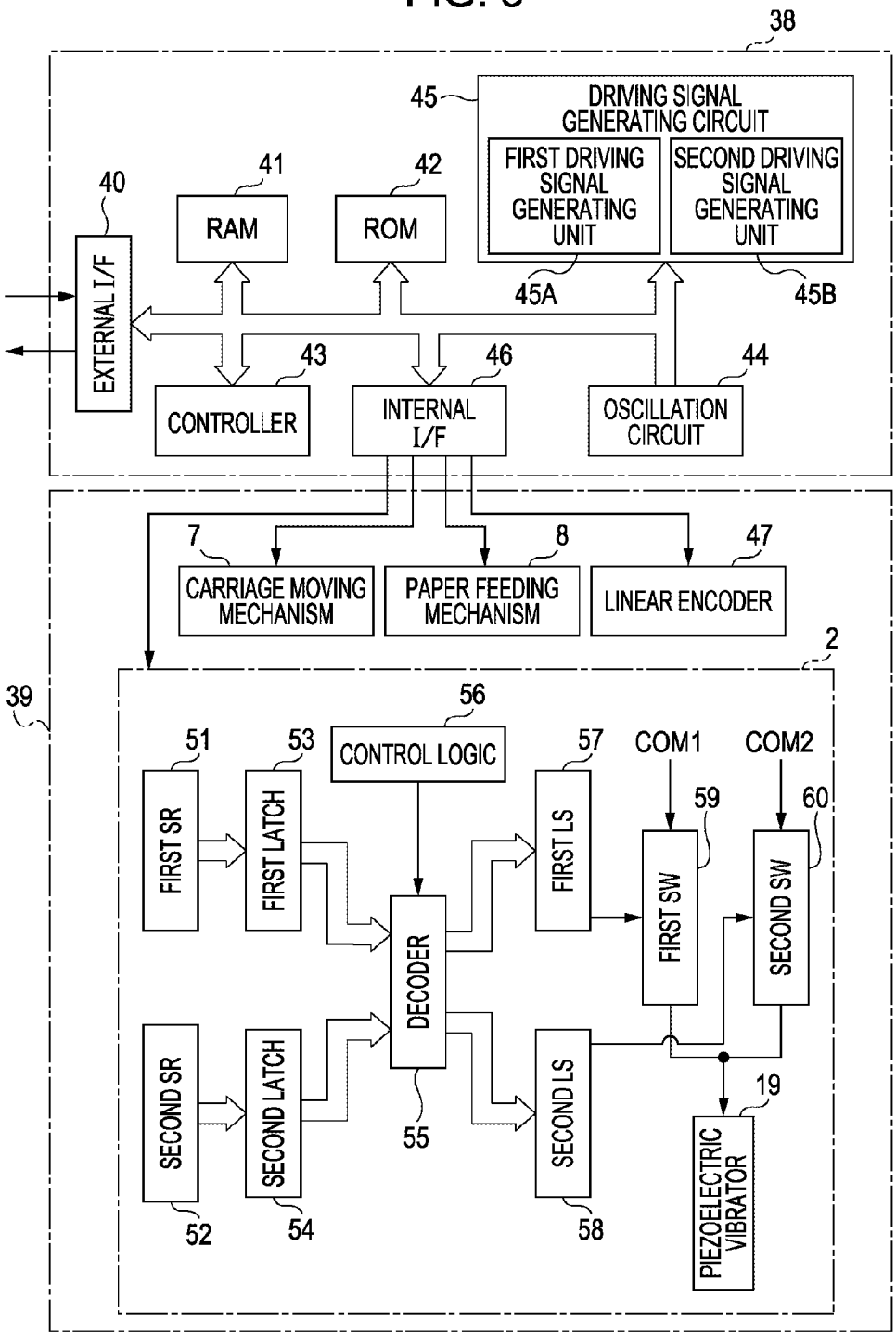
FIG. 3 is a block diagram illustrating an electrical configuration of the ink jet printer.

FIG. 3 shows a block diagram illustrating an electrical configuration of the printer. The printer includes a printer controller 38 and a print engine 39. The printer controller 38 includes an external interface 40 (external I/F) which transmits and receives data to and from an external apparatus such as a host computer (not shown), a RAM 41 which performs storing of a variety of data, a ROM 42 in which a control program for processing a variety of data and the like are stored, a controller 43 which includes a CPU or the like, an oscillation circuit 44 which generates a clock signal, a driving signal generating circuit 45 which generates a driving signal COM to be provided to the recording head 2, and an internal interface 46 (internal I/F) which transmits pixel data SI and the driving signal, etc. to the print engine 39.

The external interface 40 receives print data such as image data from the host computer or the like. Further, a state signal such as a busy signal or an acknowledge signal is output to the external apparatus from the external interface 40. The RAM 41 is used as a receiving buffer, an intermediate buffer, an output buffer, a work memory and the like. Further, the ROM 42 stores therein various control programs which are executed by the controller 43, font data, graphic functions, various procedures and the like. The print data includes image data to be printed and a variety of command data. The command data refers to data for commanding execution of a specific operation to the printer. The command data includes, for example, command data which commands paper feeding, command data which indicates a paper feeding amount, and command data which commands paper ejecting.

The controller 43 outputs a head control signal for controlling an operation of the recording head 2 to the recording head 2 and also outputs a control signal for generating the driving signal COM to the driving signal generating circuit 45. The head control signal includes, for example, a transmission clock CLK, pixel data SI, a latch signal LAT, and a change signal CH. The latch signal or the change signal defines a timing for supplying each driving pulse which forms the driving signal COM. Further, the control signal for generating the driving signal COM is, for example, a DAC (Digital to Analog Converter) value. The DAC value refers to information for instructing voltage output from the driving signal generating circuit 45, and is updated with an extremely short updating cycle.

Further, the controller 43 performs a color conversion process in which an RGB color system is converted to a CMY color system, performs a half-tone process in which multiple gray scale data is decreased to a predetermined gray scale, and performs a dot pattern forming process in which the half-tone processed data is arranged with a predetermined array according to the type of ink (for each nozzle row) to form dot pattern data, so as to generate the pixel data (dot pattern data) SI for use in the ejection control of the recording head 2. The pixel data SI refers to data on pixels of an image to be printed, and is a kind of ejecting data according to the present invention. Herein, the pixel refers to a dot forming region which is virtually determined on the recording medium such as a recording paper as a landing target. The pixel data SI in the print data includes data (gray scale) on whether or not a dot exists on the recording medium such as a recording paper (or whether ink is ejected or not) and on the size of the dot (or the amount of the ejected ink). In the present embodiment, the pixel data SI is formed by a gray scale of 2 bits. That is, the pixel data SI includes data "00" corresponding to non-dot (minute vibration), data "01" corresponding to a small dot, data "10" corresponding to a medium dot, and data "11" corresponding to a large dot. Accordingly, the dot may be formed with 4 gray scales in the printer according to the present embodiment.

The pixel data SI includes two data groups which include a higher-order bit data group corresponding to a higher-order bit of the gray scale, and a lower-order bit data group corresponding to a lower-order bit of the gray scale. Further, the controller 43 forms the pixel data SI for each nozzle row (for each type of ink), divides the pixel data for every main scanning of the recording head 2 (1 pass: a unit of relative movement between the recording head 2 and the recording medium), thereby outputting the pixel data and the driving signal COM to the recording head 2. Herein, the controller 43 calculates a variation (in the case that correction to be described later is not considered) in the amount of the ejected ink (which is a kind of ejected liquid amount) from a start of the ejecting operation to a normal state via a transitional state according to the number of generations of the gray scale for every pass, on the basis of the pixel data SI and performs switching of the ejection driving pulse during the ejecting operation on the basis of the calculated variation. Details thereof will be described later.

Figure 4:
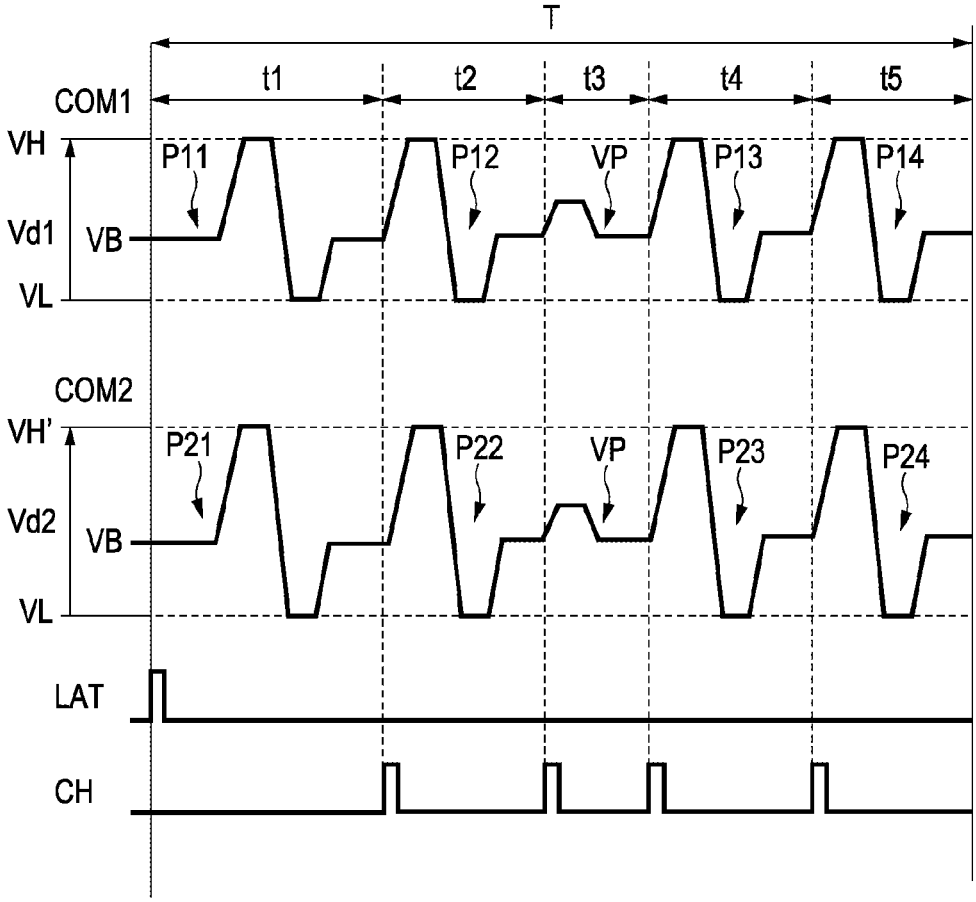
FIG. 4 is a waveform diagram illustrating a configuration of a driving signal.

The driving signal generating circuit 45 includes a first driving signal generating unit 45A capable of generating a first driving signal COM1, and a second driving signal generating unit 45B capable of generating a second driving signal COM2. As shown in FIG. 4, the driving signal COM1 according to the present embodiment is a series of signals having one minute vibration pulse and four ejection driving pulses within a predetermined generation cycle (a recording cycle) T, and is repeatedly generated within the recording cycle T. According to the present embodiment, one recording cycle T (a repetitive unit cycle of the driving signal) is divided into five periods (pulse generation periods) t1 to t5. Further, an ejection driving pulse P11 is generated at the period t1; an ejection driving pulse P12 is generated at the period t2; a minute vibration pulse VP is generated at the period t3; an ejection driving pulse P13 is generated at the period t4; and an ejection driving pulse P14 is generated at the period t5.

Meanwhile, like the first driving signal COM1, the second driving signal COM2 is a series of signals having one minute vibration pulse and four ejection driving pulses within the predetermined generation cycle (the recording cycle) T, and is repeatedly generated within the recording cycle T. Further, an ejection driving pulse P21 is generated at the period t1; an ejection driving pulse P22 is generated at the period t2; the minute vibration pulse VP is generated at the period t3; an ejection driving pulse P23 is generated at the period t4; and an ejection driving pulse P24 is generated at the period t5. The driving signals COM1 and COM2 will be described later in more detail.

Next, the print engine 39 will be described. As shown in FIG. 3, the print engine 39 includes the recording head 2, the carriage moving mechanism 7, the paper feeding mechanism 8, a linear encoder 47 and the like.

The recording head 2, as shown in FIG. 3, includes a shift register (SR) circuit having a first shift register 51 and a second shift register 52, a latch circuit having a first latch circuit 53 and a second latch circuit 54, a decoder 55, a control logic 56, a level shifter (LS) circuit having a first lever shifter 57 and a second level shifter 58, a switch circuit (SW) having a first switch 59 and a second switch 60, and the piezoelectric vibrator 19. The shift registers 51 and 52, the latch circuits 53 and 54, the level shifters 57 and 58, the switches 59 and 60, and the piezoelectric vibrator 19 are provided as the number corresponding to each nozzle 30, respectively. In FIG. 3, a configuration for one nozzle is illustrated and configurations for the other nozzles are omitted.

The recording head 2 controls the ink ejecting operation on the basis of the pixel data SI transmitted from the printer controller 38. According to the present embodiment, since the higher-order bit group of the 2-bit pixel data SI and the lower-order bit group of the 2-bit pixel data SI are sequentially synchronized with the clock signal CLK to be transmitted to the recording head 2, the higher-order bit group of the pixel data SI is firstly set to the second shift register 52. After the higher-order bit group of the pixel data SI is set to the second shift register 52 with respect to all the nozzles 30, the higher-order bit group is shifted to the first shift register 51. At the same time, the lower-order bit group of the pixel data SI is set to the second shift register 52.

The first latch circuit 53 is connected to a rear end of the first shift register 51 and the second latch circuit 54 is connected to a rear end of the second shift register 52. If a latch pulse is input to the latch circuits 53 and 54 from the printer controller 38, the first latch circuit 53 latches the higher-order bit group of the pixel data SI and the second latch circuit 54 latches the lower-order bit group of the pixel data SI. The pixel data SI (the higher-order bit group and the lower-order bit group) latched by the latch circuits 53 and 54 is output to the decoder 55, respectively. The decoder 55 generates pulse selection data for selecting each pulse which forms the driving signals COM1 and COM2 on the basis of the higher-order bit group and the lower-order bit group of the pixel data SI. The pulse selection data is generated for each of the driving signals COM1 and COM2. For example, in the case of the first driving signal COM1 in FIG. 2, the pulse selection data is formed by 5-bit data corresponding to the ejection driving pulse P11 (period t1), the ejection driving pulse P12 (period t2), the minute vibration pulse VP (period t3), the ejection driving pulse P13 (period t4) and the ejection driving pulse P14 (period t5). Similarly, in the case of the second driving signal COM2, the pulse selection data is formed by 5-bit data corresponding to the ejection driving pulse P21 (period t1), the ejection driving pulse P22 (period t2), the minute vibration pulse VP (period t3), the ejection driving pulse P23 (period t4) and the ejection driving pulse P24 (period t5).

A timing signal is input to the decoder 55 from the control logic 56. The control logic 56 generates the timing signal in synchronization with the input of a latch signal or a channel signal. Each pulse selection data generated by the decoder 55 is sequentially input to the level shifters 57 and 58 from the higher-order bit at a timing determined by the timing signal. The level shifters 57 and 58 serve as a voltage amplifier and output an electric signal having a voltage capable of driving the switches 59 and 60, for example, several tens of voltages in the case that the pulse selection data is "1".

The first driving signal COM1 is supplied to an input part of the first switch 59 and the second driving signal COM2 is supplied to an input part of the second switch 60. Further, the piezoelectric vibrator 19 is connected to an output part of the switches 59 and 60. That is, the first switch 59 performs switching of supplying and non-supplying of the first driving signal COM1 to the piezoelectric vibrator 19, and the second switch 60 performs switching of supplying and non-supplying of the second driving signal COM2 to the piezoelectric vibrator 19. The first switch 59 and the second switch 60 performing the above-described switching serve as a selection supplying unit. The pulse selection data controls the operation of the switches 59 and 60. In other words, in the period when the pulse selection data input to the switches 59 and 60 is "1", the switches 59 and 60 are in a conduction state and thus the driving signal COM1 is supplied to the piezoelectric vibrator 19. Meanwhile, in the period when the pulse selection data input to the switches 59 and 60 is "0", the switches 59 and 60 are in a cut-off state and thus the driving signal is not supplied to the piezoelectric vibrator 19. In short, the pulse in the period when the pulse selection data is set to "1" is selectively supplied to the piezoelectric vibrator 19. According to the above-described switch control, the ejection driving pulse included in the first driving signal COM1 or the second driving signal COM2 may be applied to the piezoelectric vibrator 19. In other words, a part of the driving signal COM may be selectively applied to the piezoelectric vibrator 19. In the present embodiment, at a boundary time (time of the change pulse of the change signal CH) between t1 and t5 after the start (time of the latch pulse of the latch signal LAT) of the repetitive cycle (recording cycle) T, the pulse to be applied to the piezoelectric vibrator 19 may be switched.

Figure 5A:
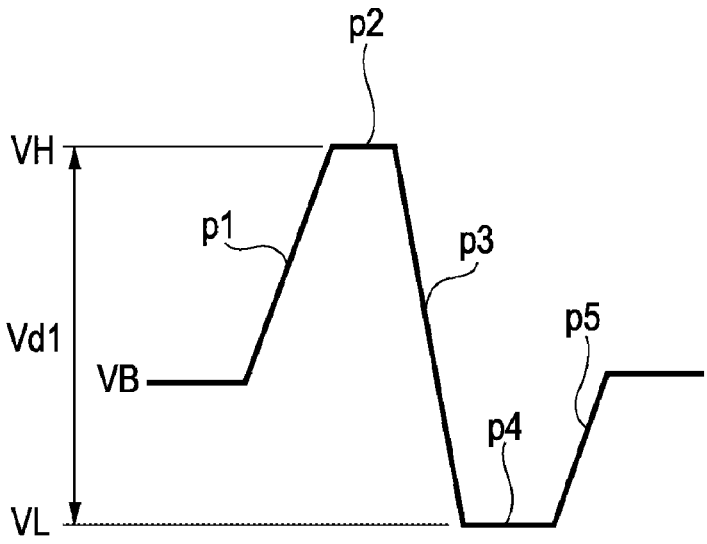
FIGS. 5A and 5B are waveform diagrams illustrating configurations of the ejection driving pulses.
Figure 5B:
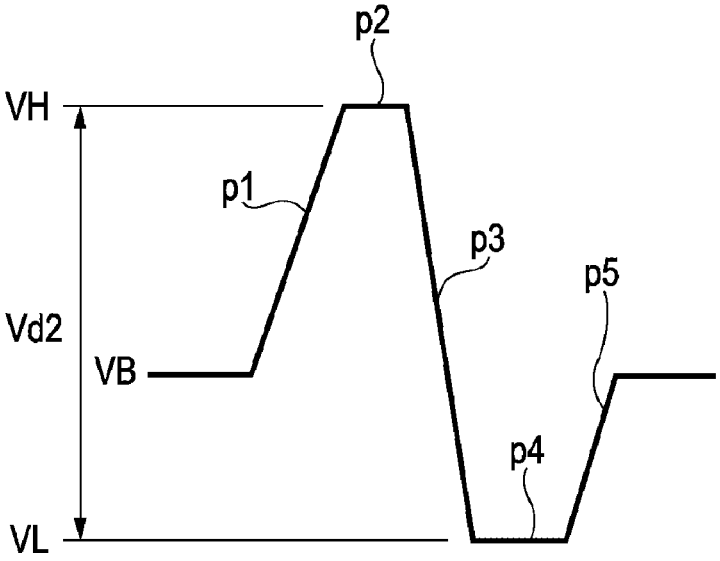

FIG. 5 illustrates a waveform of the ejection driving pulse according to the present embodiment, in which FIG. 5A illustrates a configuration of the first ejection driving pulse of the first driving signal COM1 and FIG. 5B illustrates a configuration of the second ejection driving pulse of the second driving signal COM2. As shown in FIG. 5A, each of the first ejection driving pulses P11 to P14 included in the first driving signal COM1 includes an expansion component p1, an expansion hold component (expansion maintenance component) p2, a contraction component p3, a vibration control hold component p4 and a vibration control component p5. Generally (at the time of initial setting), an ejecting operation of the ink is performed by use of the first ejection driving pulse. The expansion component p1 refers to a waveform component in which an electric potential is increased with a relatively smooth constant gradient to such a degree that the ink may not be ejected between a medium potential VB (a reference potential) corresponding to a normal volume (volume which is a reference of expansion or contraction) of the pressure generating chamber 28 and a expansion potential VH, and the expansion hold component p2 refers to a waveform component which is maintained constantly at the expansion potential VH. The contraction component p3 refers to a waveform component in which the electric potential is decreased with a steep gradient from the expansion potential VH to the contraction potential VL, and the vibration control hold component p4 refers to a waveform component which is maintained at the contraction potential VL for a predetermined period. Further, the vibration control component p5 refers to a waveform in which the electric potential is increased with a constant gradient to such a degree that the ink may not be ejected between the contraction potential VL and the medium potential VB.

When the first ejection driving pulses P11 to P14 having the above-described configuration are supplied to the piezoelectric vibrator 19, the piezoelectric vibrator 19 contracts by the expansion component p1 and thus the island portion 35 of the diaphragm 33 moves away from the pressure generating chamber 28. Accordingly, the pressure generating chamber 28 expands from the normal volume corresponding to the medium potential VB to the expansion volume corresponding to the expansion potential VH. According to this expansion, a meniscus is rapidly drawn toward the pressure generating chamber 28, and simultaneously ink is supplied from the reservoir 26 to the pressure generating chamber 28 through the ink supply port 27. The expansion state of the pressure generating chamber 28 is maintained during the generation of the expansion hold component p2. Then, the piezoelectric vibrator 19 extends by applying the contraction component p3, and thus the island portion 35 moves toward the pressure generating chamber 28. Accordingly, the pressure generating chamber 28 rapidly contracts from the expansion volume to the contraction volume corresponding to the contraction potential VL. The ink in the pressure generating chamber 28 is pressurized by the rapid contraction of the pressure generating chamber 28 and thus a predetermined amount of ink (for example, several nanograms to about a dozen nanograms) is ejected from the nozzle 30. The contraction state of the pressure generating chamber 28 is maintained while the vibration control hold component p4 is supplied. At this time, the pressure of the ink in the pressure generating chamber 28 which has been decreased by the ejected ink increases again due to its unique vibration. The vibration control component p5 is adjusted to be supplied during the pressure increasing time. The pressure generating chamber 28 expands to the normal volume by the supply of the vibration control component p5, thereby to absorb pressure variation (residual vibration) of the ink within the pressure generating chamber 28.

As shown in FIG. 5B, like the first ejection driving pulses P11 to P14, each of the second ejection driving pulses P21 to P24 included in the second driving signal COM2 includes an expansion component p1, an expansion hold component p2, a contraction component p3, a vibration control hold component p4, and a vibration control component p5. However, the driving voltage (potential difference between the lowest potential and the highest potential) thereof is different from that of the first ejection driving pulse. In addition, the controller 43, the switches 59 and 60, etc. which serve as an ejection control unit in the present invention perform control so that the first ejection driving pulse of the first driving signal COM1 and the second ejection driving pulse of the second driving signal COM2 are switched, at the time when the amount of an ejected ink becomes a predetermined correction target value in the transition of the ejected ink amount of each nozzle 30 from the start of the ejecting operation, in the case that an operation in which the ink is simultaneously ejected from the plurality of nozzles 30 (for example, half or more of the nozzles 30) in the nozzle row is continuously performed at a short cycle such as a case that solid recording (solid recording) with respect to the recording medium such as a recording paper is performed, which will be described hereinafter.

When manufacturing such a printer, a parameter of each of the ejection driving pulses is set to obtain a desired ejection characteristic (weight or flying speed of the ejected ink). However, in the case that the ink is continuously ejected at a high frequency as described above, a flow speed in the ink supply passage from the ink cartridge to the recording head, that is, in the ink flow passage in the ink supply tube or the ink supply flow passage in the recording head according to the present embodiment is increased to increase flow resistance (particularly, flow resistance in a portion closer to an inner wall surface of the flow passage), thereby generating pressure loss. Accordingly, even though the desired ejection characteristic is obtained immediately after the ejecting operation of the ink starts, the weight of the ink ejected from each nozzle 30 or the flying speed thereof is decreased as the flow speed of the ink within the flow passage is increased, and further, the ink may not be ejected from the nozzle 30 in the worst case. As a consequence, there is a possibility that a problem such as variation in the density of the recording image occurs.

Figure 6:
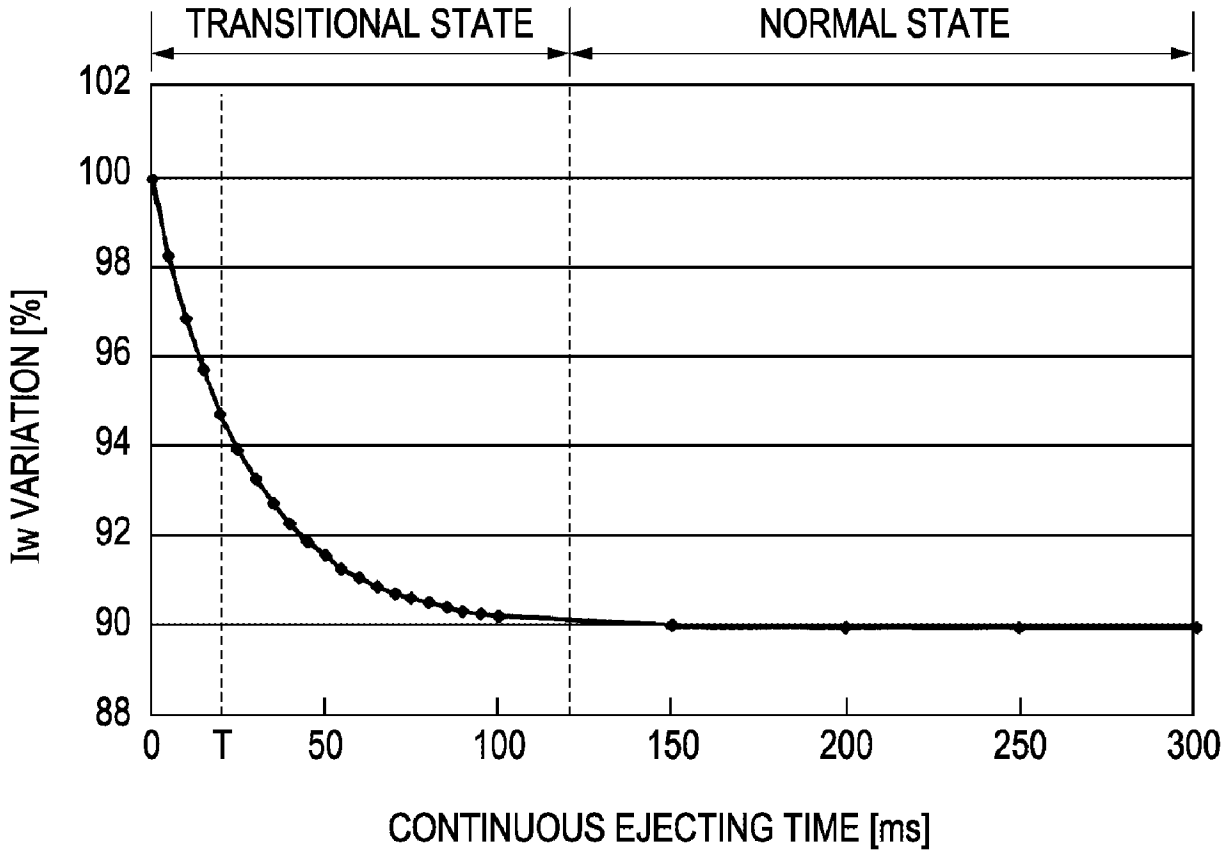
FIG. 6 illustrates a variation in an ejection characteristic when solid recording, etc. is performed.

FIG. 6 illustrates variation in the ejection characteristic (weight Iw of the ejected ink) when performing a so-called solid recording in which a predetermined region on the recording medium such as a recording paper is filled with dots without spaces therebetween. In FIG. 6, the weight of the ejected ink is set to 100% at the start of the ejecting operation. As shown in FIG. 6, as the flow speed of the ink which passes through the ink supply passage after starting the ejecting operation is rapidly increased, the weight of the ejected ink is decreased (the transitional state). After the elapse of a predetermined time (herein, after 100 to 150 ms), the flow speed of the ink is stabilized, and thus the weight of the ejected ink becomes nearly constant (the normal state). Referring to the graph in FIG. 6, the weight of the ejected ink Iw(t) at the elapse time t from the start of the ejecting operation is expressed by the following formula (1).

$$Iw(t)=A\cdot\exp(-t/\tau)+D \quad (1)$$

In the formula (1), A refers to a variation in the ejected liquid amount from the start of the ejecting operation to the normal state via the transitional state (%: in the case that correction to be described later is not performed). In the present embodiment, as described above, the controller 43 calculates a dot forming density in a direction of the nozzle row in one pass from the pixel data SI, a dot density in a head scanning direction, the size of the dots (gray scale) and a driving frequency. In addition, D refers to an asymptotic value (D=100−A %) of the amount of the ejected ink in the normal state (in the case that correction is not performed). Herein, τ refers to a time constant (τ=M/R) based on inertance M and flow passage resistance R in the ink supply passage.

In the example of FIG. 6, the weight of the ejected ink in the normal state is decreased by 10% compared with the weight of the ejected ink (100%) at the start of the ejecting operation (A=10%). Moreover, D=90% and τ=27 ms (a value at the time when variation in the weight of the ejected ink becomes 63.2%). The variation A of the weight of the ejected ink, the asymptotic value D and the time constant τ vary depending on the driving frequency, the number of nozzles simultaneously driven, the structure and specification of the driving head or the printer. Thus, it is difficult to handle the variation in the ejection characteristic which is caused by the increase in the flow speed and the flow resistance of the ink in printer of the related art.

Accordingly, the controller 43, etc. which serve as the ejection control unit in the present embodiment estimate the timing T at which the amount of the ejected ink becomes a predetermined correction target value Iwx in the transition in the ejected liquid amount of each nozzle 30 from the start of the liquid ejecting operation, and switches the ejection driving pulse for driving the piezoelectric vibrator 19 from the first ejection driving pulse of the first driving signal COM1 to the second ejection driving pulse of the second driving signal COM2 at the estimated timing T. The timing T when the ejected ink amount reaches the correction target value Iwx (a ratio % to the amount of the ink ejected at the start of the ejecting operation) is calculated by the following formula (2).

$$T=-\mathrm{Log}((Iwx-D)/A)\times\tau \quad (2)$$

For example, in the example of FIG. 6, if the correction target value Iwx is set to 95%, the timing T when the ejected ink amount reaches the correction target value Iwx from the start of the ejecting operation is −Log((95−90)/10)×27=18.7 ms. The correction target value Iwx may be randomly determined and further may be set as a plurality of values in the transitional state.

The formula (2) corresponds to the formula (NF) according to the present invention.

Then, the controller 43 drives the piezoelectric vibrator 19 using the first ejection driving pulse of the first driving signal COM1 from the start of the ejecting operation to the timing T, and drives the piezoelectric vibrator 19 using the second ejection driving pulse of the second driving signal COM2 after the timing T. Referring to the correction value (the set value) of the second ejection driving pulse, a driving voltage Vd2 of the second ejection driving pulse is set to increase the amount of the ejected ink by the variation A. That is, for example, in the above example (A=10%), the driving voltage Vd2 of the second ejection driving pulse is increased to become higher than a driving voltage Vd1 of the first ejection driving pulse. The correction method is not limited to the method of increasing the driving voltage, and may adopt a variety of known methods. For example, the medium potential VB may be decreased to become lower than that of the first ejection driving pulse, thereby increasing the pressure variation during the ejecting operation. Accordingly, a configuration in which the amount of the ejected ink is increased may be adopted. Moreover, a time interval (applying time to the piezoelectric vibrator 19) of the expansion hold component (expansion maintenance component) p2 is adjusted so that the amount of the ejected ink is increased.

As described above, since the ejection driving pulse for driving the piezoelectric vibrator 19 is switched from the first ejection driving pulse to the second ejection driving pulse at the timing T at which the amount of the ejected liquid becomes the predetermined correction target value Iwx in the transition in the amount of the ejected ink of each nozzle 30 from the start of the ejecting operation, deterioration of the ejection characteristic may be prevented in the case that the ink is continuously ejected at the high frequency from the plurality of nozzles 30. Accordingly, irregularity, etc. of the ink density on the landing target such as a recording paper may be decreased.

In particular, according to the transition in the amount of the ejected ink during the ejecting operation corresponding to a region in which the ink is ejected with a relatively high density compared with the other region of the landing target such as a recording paper, the above-described switching operation of the ejection driving pulse is performed, thereby effectively preventing irregularity of the ink density in a region where the irregularity of the ink density is easily noticeable.

While a recording operation moves from a certain pass to the next pass, the pressure loss in the flow passage of the ink is restored to the state before the start of the ejecting operation.

Herein, in the transition (transitional state) in the amount of the ejected ink of each nozzle 30 from the start of the ejecting operation, a configuration in which the plurality of correction target values are set and the switching operation (correction) of the ejection driving pulse is performed with each correction target value may be adopted. According to the above-described configuration, the variation in the amount of the ejected ink can be effectively prevented. In short, at least two ejection driving pulses having different pressure variations during the ejecting operation may be generated, and the ejection driving pulses may be switched to cover the variation in the amount of the ejected ink.

Further, in the case that the ejection frequency, the number of nozzles from which ink is simultaneously ejected, etc. vary in a certain pass, the controller 43 calculates variation in the amount of the ejected ink at the time when the flow speed reaches the anticipated highest flow speed of the ink within the ink flow passage (a flow speed at the time when the ink is continuously ejected with the highest ejection frequency from all the nozzles 30 within the nozzle row) Ub, on the basis of the pixel data SI in the corresponding pass, and then calculates a driving voltage Vdb of the ejection driving pulse capable of restoring the amount of the ejected ink to the amount of the ejected ink at the start of the ejecting operation. Moreover, the controller 43 calculates the flow speed U of the ink within the ink flow passage at the time when the ejecting operation is performed in the corresponding pass on the basis of the pixel data SI, and sets the driving voltage Vd2 of the second ejection driving pulse by the following formula (3) on the basis of the calculated value.

$$Vd2=Vd1+(Vdb-Vd1)\times(U/Ub) \quad (3)$$

However, the present invention is not limited to the above-described embodiments, and may adopt a variety of variations on the basis of the scope of the accompanying claims.

For example, the waveform of the ejection driving pulse is not limited to the exemplified embodiments, and the present invention is applicable to a variety of ejection driving pulses. In short, any ejection driving pulse which at least includes the expansion component that expands the pressure generating chamber, the expansion maintenance component that maintains the expansion state for a predetermined time, and the contraction component that contracts the expanded pressure generating chamber to eject the liquid may be applicable.

In addition, in the present embodiment, the configuration in which the variation A (%: the case that correction is not performed) in the amount of the ejected ink from the start of the ejecting operation via the transitional state to the normal state is calculated on the basis of the pixel data SI for every pass is exemplified. However, the present invention is not limited thereto. For example, a continuous ejection time in the pass (ejection maintenance time) is calculated and the variation A may be estimated from the calculated time.

The present invention is applicable to a variety of ink jet recording apparatuses such as a plotter, a facsimile apparatus, and a copy apparatus. Moreover, the invention is applicable to a liquid ejecting apparatus capable of controlling the ejecting operation of the liquid using the driving signal (ejection driving pulse), such as a display manufacturing apparatus, an electrode manufacturing apparatus, and a chip manufacturing apparatus, other than the recording apparatus.

What is claimed is:

1. A liquid ejecting apparatus comprising:

a liquid ejecting head which includes a nozzle group formed by arranging a plurality of nozzles, introduces a liquid to a pressure generating chamber through a liquid supply passage from a liquid supply source, drives a pressure generating element to generate pressure variation in the liquid in the pressure generating chamber and ejects the liquid from the nozzles using the pressure variation;

a driving signal generating unit which generates a driving signal including an ejection driving pulse which drives the pressure generating element; and an ejection control unit which controls an application of the ejection driving pulse to the pressure generating element to control a liquid ejecting operation of the liquid ejecting head, wherein the driving signal generating unit is capable of generating a first ejection driving pulse and a second ejection driving pulse which generates pressure variation larger than that of the first ejection driving pulse, and wherein the ejection control unit calculates a timing T at which the amount of the ejected liquid becomes a predetermined correction target value Iwx in transition of the ejected liquid amount of each nozzle from the start of the ejecting operation, on the basis of the following formula (NF), $$T=-\mathrm{Log}((Iwx-D)/A)\times\tau \quad \text{(NF)}$$

and switches the ejection driving pulse which drives the pressure generating element from the first ejection driving pulse to the second ejection driving pulse at the calculated timing T, where in the formula (NF), A refers to a variation in the ejected liquid amount from the start of the ejecting operation to a normal state via a transitional state (in the case that correction is not performed), D refers to an asymptotic value of the ejected liquid amount in the normal state (in the case that correction is not performed), and τ refers to a time constant (τ=M/R) based on inertance M and flow passage resistance R in the liquid supply passage.

2. The liquid ejecting apparatus according to claim 1, wherein the ejection control unit calculates the variation A on the basis of ejecting data in each unit of relative movement between the liquid ejecting head and a landing target.

3. The liquid ejecting apparatus according to claim 2, wherein the ejection control unit performs the switching of the ejection driving pulse according to the transition in the ejected liquid amount at the time of the liquid ejecting operation corresponding to a region in which the liquid is landed with a relatively high density compared with the other region of the landing target.

4. The liquid ejecting apparatus according to claim 1, wherein the ejection control unit estimates the variation A from a continuous ejecting time.

5. A method of controlling a liquid ejecting apparatus which includes: a liquid ejecting head which includes a nozzle group formed by arranging a plurality of nozzles, introduces a liquid to a pressure generating chamber through a liquid supply passage from a liquid supply source, drives a pressure generating element to generate pressure variation in the liquid in the pressure generating chamber and ejects the liquid from the nozzles using the pressure variation; a driving signal generating unit which generates a driving signal including an ejection driving pulse which drives the pressure generating element; and an ejection control unit which controls an application of the ejection driving pulse to the pressure generating element to control a liquid ejecting operation of the liquid ejecting head, the method comprising:

calculating a timing T at which an ejected liquid amount becomes a predetermined correction target value Iwx in transition of the ejected liquid amount of each nozzle from a start of the liquid ejecting operation on the basis of the following formula (NF)

$$T=-\mathrm{Log}((Iwx-D)/A)\times\tau \quad \text{(NF); and}$$

switching the ejection driving pulse which drives the pressure generating element from a first ejection driving pulse to a second ejection driving pulse which generates pressure variation larger than that of the first ejection driving pulse, where in the formula (NF), A refers to a variation in the ejected liquid amount from the start of the ejecting operation to a normal state via a transitional state (in the case that correction is not performed), D refers to an asymptotic value of the ejected liquid amount in the normal state (in the case that correction is not performed), and τ refers to a time constant (τ=M/R) based on inertance M and flow passage resistance R in the liquid supply passage.

* * * * *